US007591299B1

(12) United States Patent
Gordon et al.

(10) Patent No.: US 7,591,299 B1
(45) Date of Patent: Sep. 22, 2009

(54) CONTINUOUS METAL MATRIX COMPOSITE MANUFACTURE

(75) Inventors: Brian L. Gordon, Wheeling, WV (US); Gregg W. Wolfe, Wheeling, WV (US)

(73) Assignee: Touchstone Research Laboratory, Ltd., Triadelphia, WV (US)

( * ) Notice: Subject to any disclaimer, the term of this patent is extended or adjusted under 35 U.S.C. 154(b) by 0 days.

(21) Appl. No.: 10/995,274

(22) Filed: Nov. 24, 2004

Related U.S. Application Data

(60) Provisional application No. 60/525,838, filed on Dec. 1, 2003.

(51) Int. Cl.
*B22D 19/00* (2006.01)
*B22D 11/00* (2006.01)
*B05C 3/05* (2006.01)

(52) U.S. Cl. ..... 164/419; 164/461; 118/405; 118/423

(58) Field of Classification Search ..... 164/461, 164/419, 91, 97; 118/405, 423; 427/431, 427/434.6

See application file for complete search history.

(56) References Cited

U.S. PATENT DOCUMENTS

| | | | | |
|---|---|---|---|---|
| 4,082,864 | A * | 4/1978 | Kendall et al. | 427/255.24 |
| 4,285,749 | A * | 8/1981 | Stiles | 156/180 |
| 4,649,060 | A * | 3/1987 | Ishikawa et al. | 427/601 |
| 4,728,387 | A * | 3/1988 | Hilakos | 156/441 |
| 5,540,797 | A * | 7/1996 | Wilson | 156/180 |
| 6,131,285 | A * | 10/2000 | Durand | 29/897.2 |
| 6,344,270 | B1 * | 2/2002 | McCullough et al. | 428/389 |
| 6,485,796 | B1 * | 11/2002 | Carpenter et al. | 427/601 |
| 6,660,088 | B2 * | 12/2003 | Negishi et al. | 118/405 |

* cited by examiner

*Primary Examiner*—Kevin P Kerns
(74) *Attorney, Agent, or Firm*—Philip D. Lane

(57) ABSTRACT

A method and apparatus for the production of long lengths of continuous-fiber metal matrix composite prepeg ribbon or tape. The tape or ribbon is produced by bringing together multiple fiber tows into a formed bundle of fibers and infiltrating the bundle with metal using a continuous pultrusion process. Pultrusion is a preferred method of tape or ribbon manufacture since it places the fibers in tension during manufacture and avoids subsequent issues associated with buckling stress.

10 Claims, 6 Drawing Sheets

CONTINUOUS METAL MATRIX COMPOSITE MANUFACTURE

CROSS-REFERENCE TO RELATED APPLICATIONS

The present application claims priority to U.S. Provisional Patent Application No. 60/525,838, filed Dec. 1, 2003.

This invention was made with Government support under contract number DAAD 19-01-2-0006 awarded by the Army Research Laboratory. The Government has certain rights in the invention.

FIELD OF THE INVENTION

The present invention relates to metal matrix composites and more particularly to methods and apparatus for the manufacture of aluminum matrix composites.

BACKGROUND OF THE INVENTION

The next generation of high technology materials for the use in, for example, aerospace and aircraft applications will need to possess high temperature capability combined with high stiffness and strength. Plates and shells fabricated from laminated composites, as opposed to monolithic materials provide the potential for meeting these requirements and thereby significantly advancing the designer's ability to meet the required elevated temperature and structural strength and stiffness specifications while minimizing weight.

Laminated composites of these types generally comprise relatively long lengths, preferably continuous throughout their length, of a reinforcing fibrous material such as a ceramic, carbon, and the like, in a matrix of a metal such as aluminum.

Currently, the metal matrix materials, so called prepegs, that form the basis for these laminated systems are very expensive to produce, and, in some cases of variable properties along the length of the laminate, both of which conditions have inhibited their proliferation and use in the aforementioned applications.

Accordingly, it would be highly desirable to have methods and apparatus for the manufacture of such metal matrix composite prepeg materials that is reliable, relatively inexpensive and produce a consistent product with the properties desired by aerospace and aircraft designers.

SUMMARY OF THE INVENTION

The present invention provides a method and apparatus for the production of long lengths of continuous-fiber metal matrix composite prepeg ribbon or tape. The tape or ribbon is produced by the bringing together multiple fiber tows into a formed bundle of fibers and infiltrating the bundle with metal using a continuous pultrusion process. Pultrusion is a preferred method of tape or ribbon manufacture since it places the fibers in tension during manufacture and avoids subsequent issues associated with buckling stress.

DETAILED DESCRIPTION

The present invention provides a method for the production of long lengths of continuous-fiber metal matrix composite prepeg ribbon or tape. The tape or ribbon is produced by bringing together multiple fiber tows into a formed bundle of fibers and infiltrating the bundle with metal during a continuous pultrusion process. Pultrusion is a preferred method of tape or ribbon manufacture since it places the fibers in tension during manufacture and avoids subsequent issues associated with buckling stress.

The feedstocks or input materials for the production of metal matrix prepeg tapes or ribbons in accordance with the methods and in the apparatus described herein, comprise a metallic matrix material such as, in the instantly preferred case, aluminum and any of a broad variety of variety of long, continuous fibers of materials such as glass, ceramics, carbon, and the like, some of which are commonly known and to one extent or another have been incorporated into metal matrix tapes or ribbons with varying degrees of success in terms of process efficiency and the properties of the finished tape or ribbon product. It is the fibers that provide the high strength component of the material system and the matrix metal that which serves to hold the fiber bundle together and transfer the load to the fibers uniformly. Among the preferred fibrous reinforcing material are Nextel 610™ alumina ($Al_2O_3$) commercially available from the 3-M Corporation, and various glass fibers that are supplied in long continuous lengths as strength enhancement reinforcers.

The fibrous input materials are commonly, and in the instant process similarly, supplied in a form referred to as roving or tow. A tow is simply an untwisted bundle of continuous filaments that form a long continuous fiber in their combined, but untwisted from. Typically, a tow would contain between several hundred up to tens of thousands of individual filaments, depending upon the composition of the tow, the desired strength/stiffness of the tape or ribbon etc. A tow is wound onto spools in much the same fashion that thread is wound onto a spool for sewing. A given spool of fiber typically contains several thousand feet of continuous fibrous material.

The matrix metal may be purchased commercially in any of a number of forms such as ingot, billet, pig, and the like, and is melted in a suitable furnace as described below for purposes of infiltration of the tow, also described below.

Figure 1:
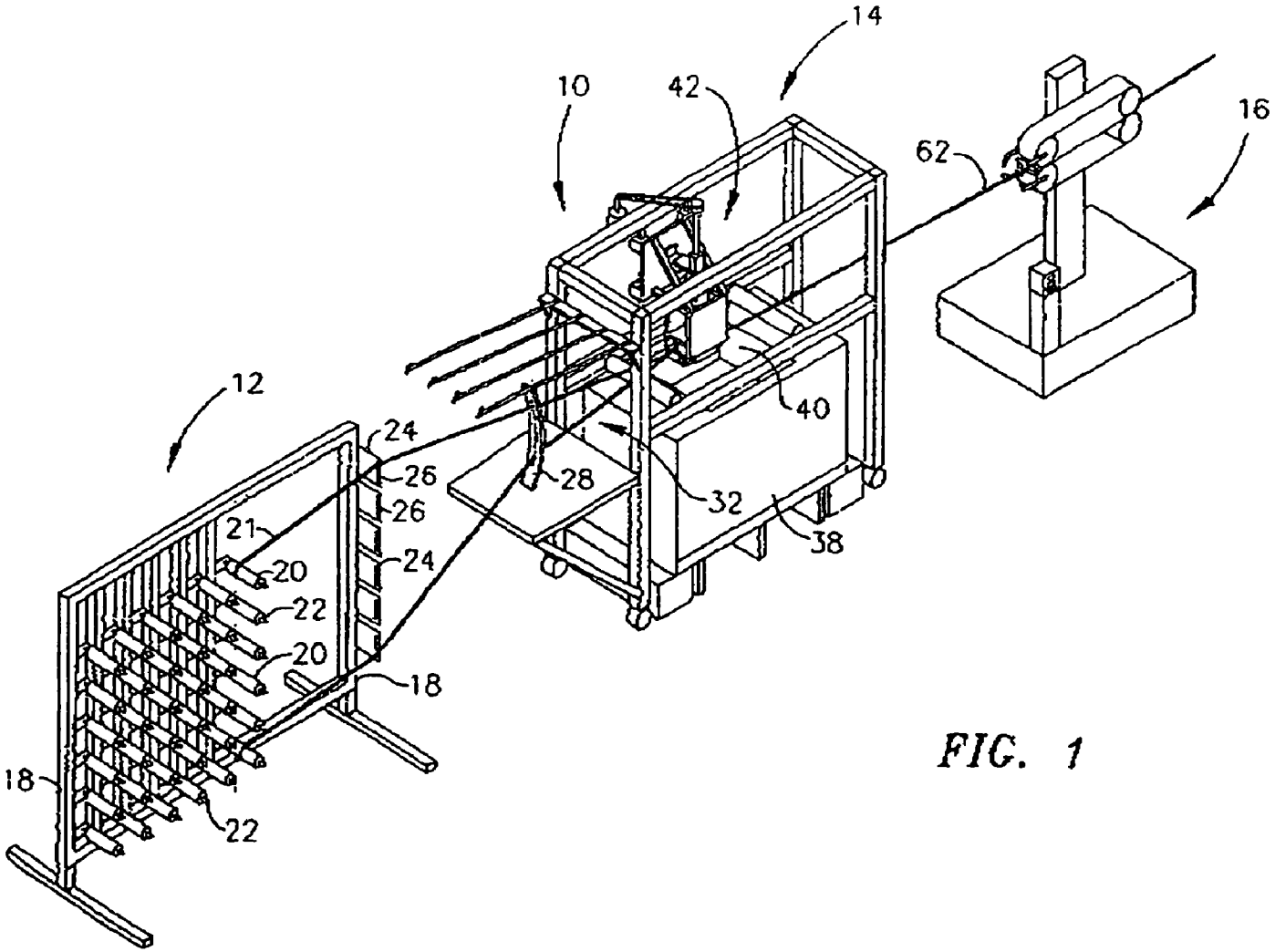
FIG. 1 is a perspective view of the metal matrix tape or ribbon fabrication apparatus of the present invention.

Referring now to FIG. 1, apparatus 10 of the present invention comprises a creel 12, an infiltration section 14 and a puller 16. Each of these apparatus sections will be described separately and in detail and then the relationships between and among the individual elements defined and the operation of the apparatus described.

Figure 3:
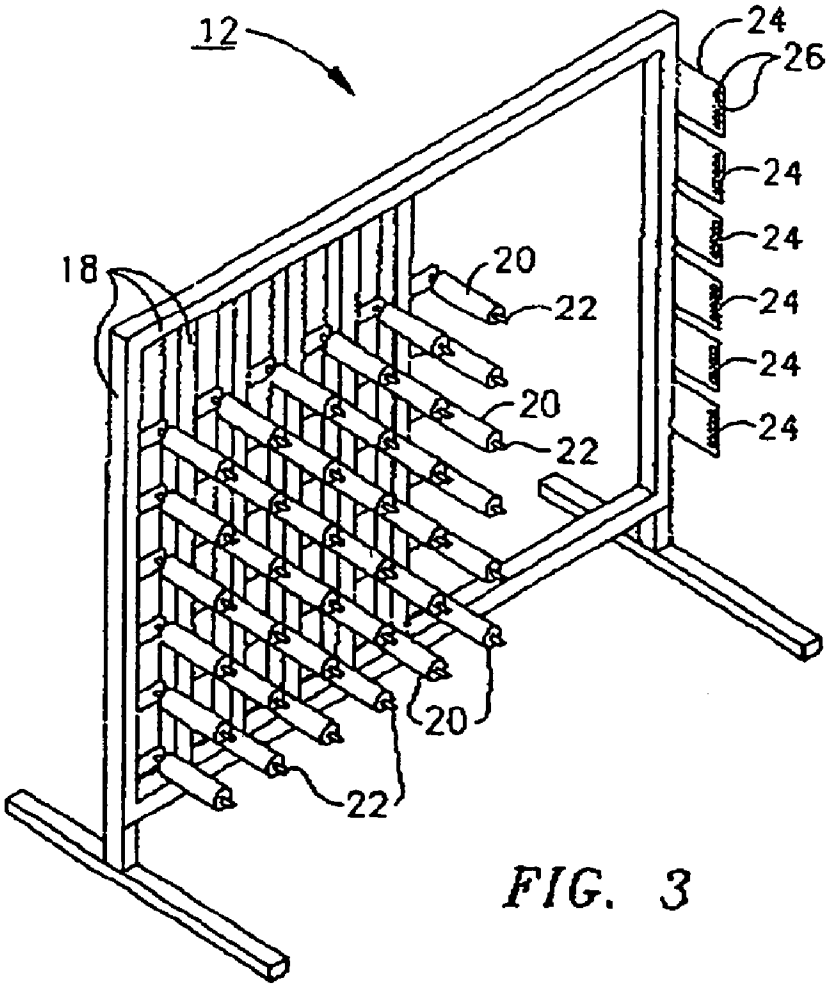
FIG. 3 is a perspective view of the creel section of the metal matrix tape or ribbon fabrication apparatus of the present invention.
Figure 2:
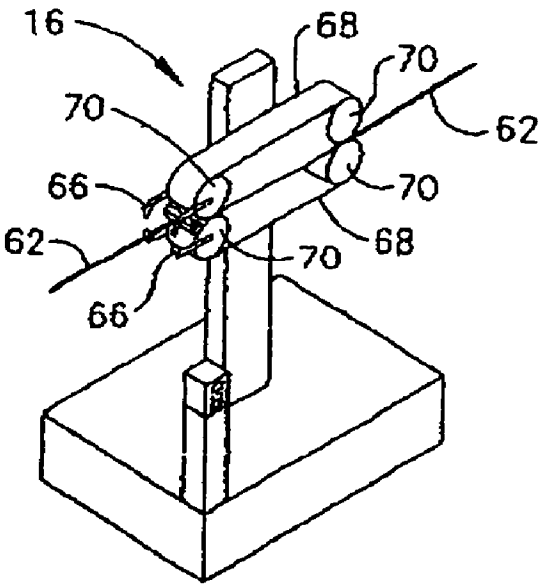
FIG. 2 is a perspective view of the puller section of the fabrication apparatus of the present invention.

As best seen in FIGS. 1 and 3, creel 12 comprises a vertical frame 18 having a series of vertical and horizontal rows of spools 20 rotatably mounted thereon via their engagement with shafts 22 that are fixed to frame 18 in the rowed arrangement shown in FIGS. 1 and 3. Spools 20 contain continuous fiber tow 21 wrapped thereon (best seen in FIG. 1). The tension applied to each of spools 20 is controlled by an individual spool tensioning device (not specifically shown) that may, for example comprise a magnetic clutch or the like. Such devices are well known in the art and well within the skill of the skilled artisan to fabricate and incorporate into creels of the type described herein. Tensions on the order of from about 10 to about 100 grams have been found satisfactory in the tape or ribbon fabrication process described herein. Also mounted on frame 18 are creel payout boards 24 having apertures 26 therein. Due to the manner in which tow fiber 21 is wound onto spools 20, there is a traversing action as tow 21 is pulled off of spools 20. In other words, the payout traverses back and forth from one end of spools 20 to the other. To eliminate the effects of this traversing action on the infiltration process described hereinafter, tow 21 is sent through a payout board 24 located several feet in front of spools 20. This gives the individual tows 21 a consistent starting point as they enter the balance of the process. The outer periphery of apertures 26 is preferably lined or coated with a suitable abrasion resistance material such as ceramic, for example silicon carbide, boron nitride and the like that resists abrasion by the fibrous reinforcing material that is fed therethrough as described below. Creel payout boards 24 and accordingly apertures 26 are mounted perpendicular to the direction of travel of tow 21 as it travels through apparatus 10 as shown in FIG. 1 and described below.

As tow 21 passes through individual apertures 26 in a single creel payout board 24 or through a multiplicity of apertures 26 in a plurality of payout boards 24, the individual tows are aligned in the direction of infiltration section 14.

Before actual entry into infiltration section 14, however, tow fibers 21 pass through a condenser board 28 having a series of apertures 30 (see FIG. 5) similar to apertures 26 therein. The purpose of condenser board 28 is to further define the shape and arrangement of the tow bundle 32 that is being formed as the individual tow fibers 21 are brought closer to infiltration section 14. The particular profile, i.e. flat, rectangular etc., of tow bundle 32 desired will determine the shape of condenser board 28 as well as the spacing and location of apertures 30 therein. In the embodiment depicted in FIGS. 1 and 4, condenser board 28 is shown as arcuate with the concave side facing downstream, i.e. in the direction of the infiltration section 14, in the fabrication process. Condenser board 28 is preferably provided with a swivel clamp or similar device to permit ready adjustment of its vertical orientation relative to infiltration section 14. This configuration of condenser board 28 permits proper lay down of tow bundle 32. i.e. application of proper bandwidth of tow bundle 32 on entrance roller 34 best seen in FIGS. 5 and 6.

Entrance roller 34 preferably comprises a lightweight roller of conventional design but with free rolling high-temperature bearings. Entrance roller 34 serves to flatten and redirect tow bundle 32 as it approaches the entry to infiltration section 14 that begins with entrance tube 36.

Figure 4:
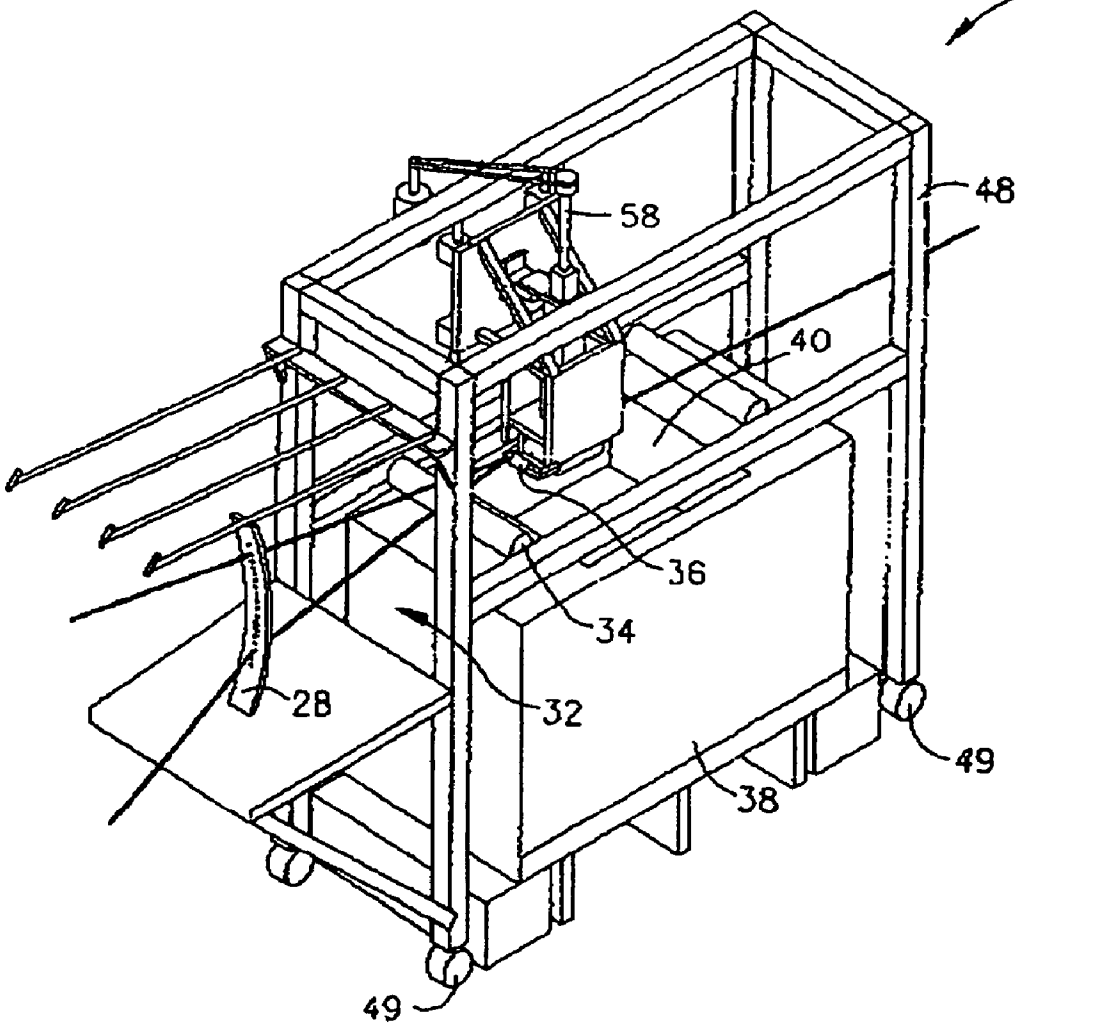
FIG. 4 is a perspective view of the infiltration section of the metal matrix tape or ribbon fabrication apparatus of the present invention.
Figure 5:
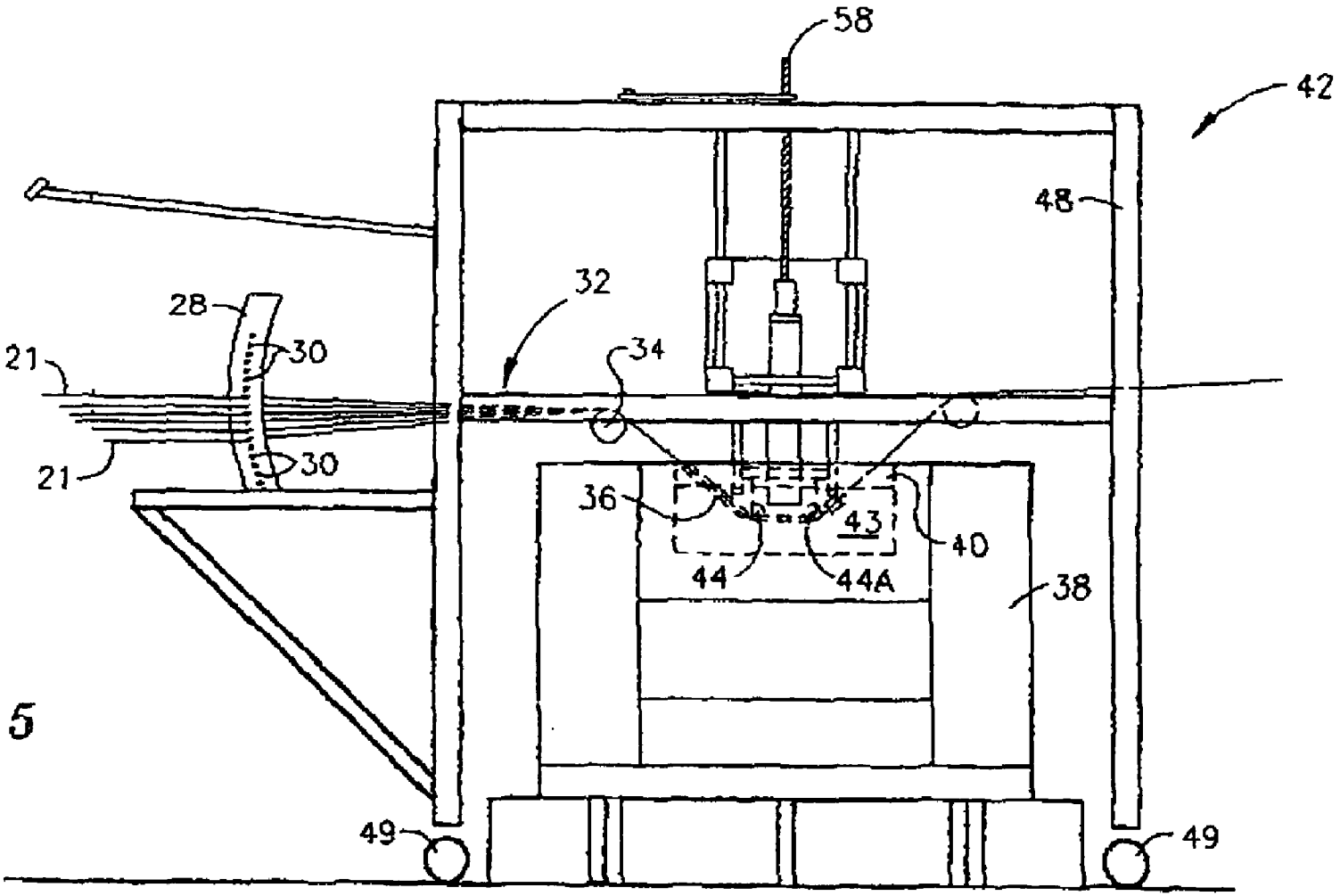
FIG. 5 is a partially cutaway front view of the infiltration section of the metal matrix tape or ribbon fabrication apparatus of the present invention.
Figure 6:
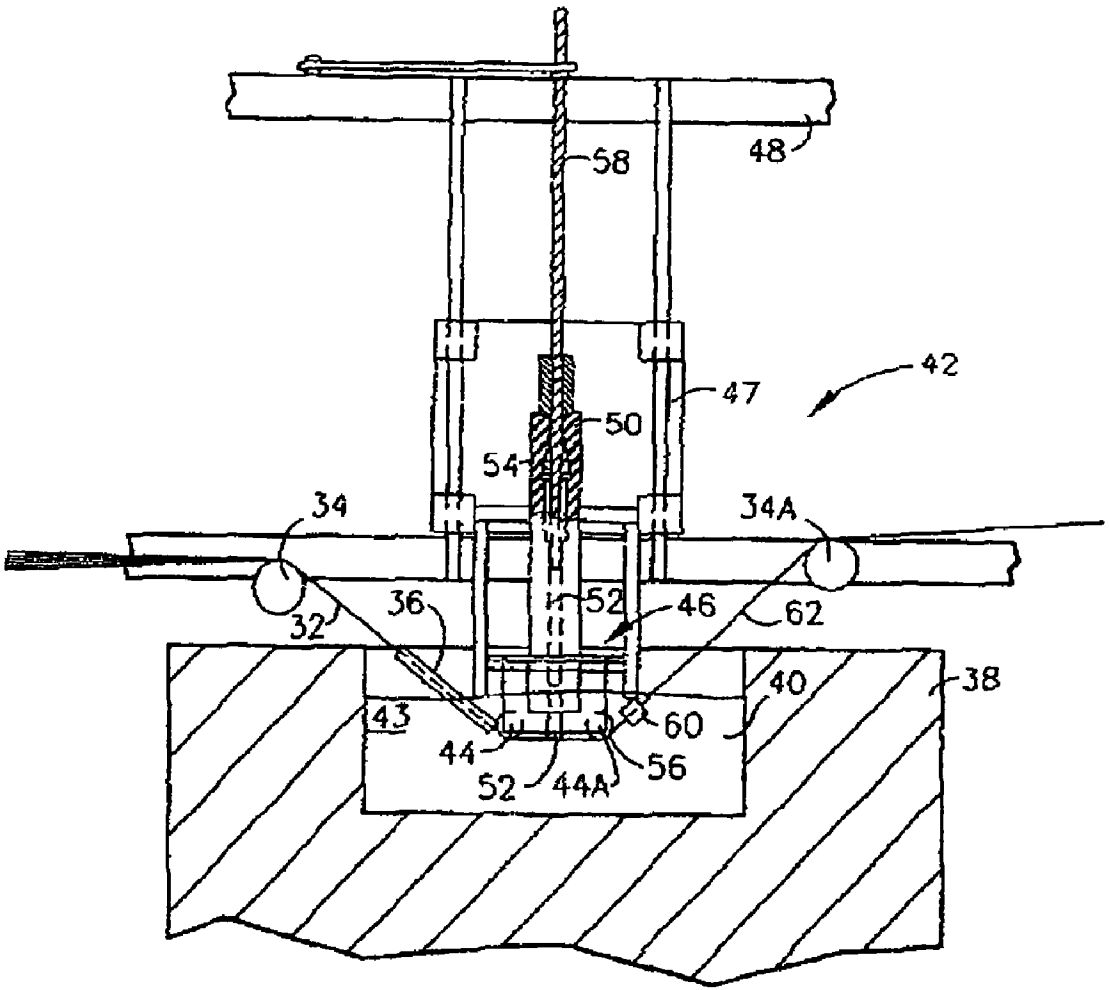
FIG. 6 is a detailed cutaway view of the tape handling portion of the infiltration section of the metal matrix tape or ribbon fabrication apparatus of the present invention.
Figure 8:
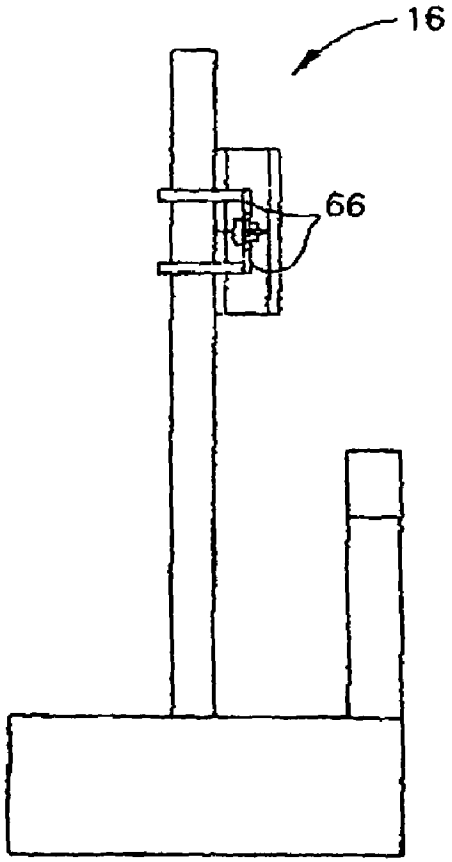
FIG. 8 is an end view of the puller section depicted in FIG. 2.
Figure 7:
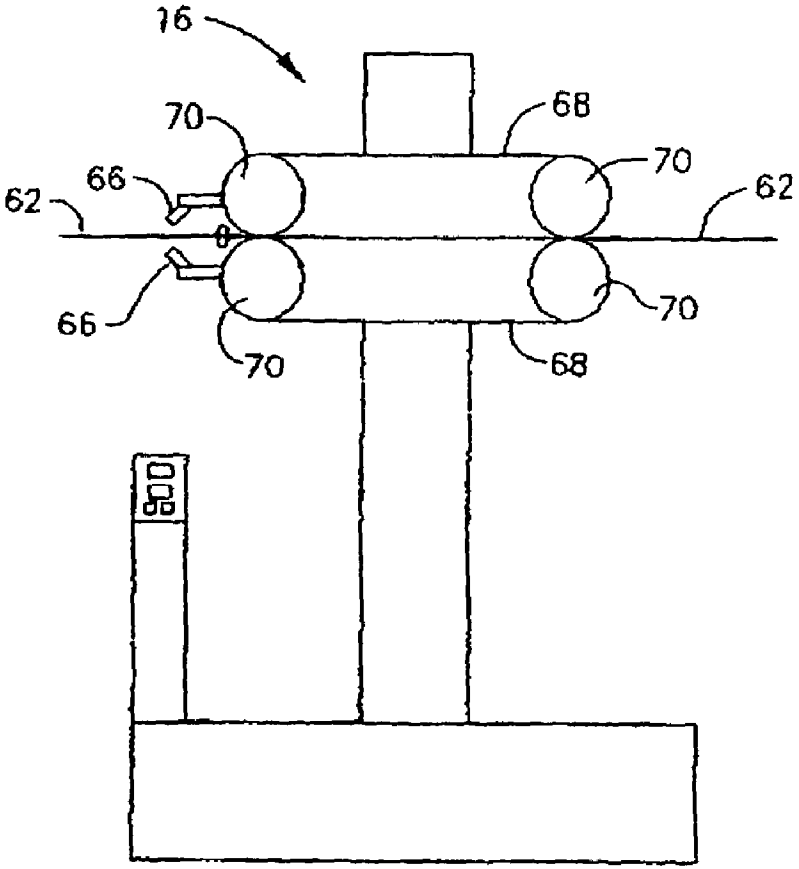
FIG. 7 is a front view of the puller section depicted in FIG. 2.

Infiltration section 14 comprises two parts: 1) a furnace 38 having a molten metal well 40 and 2) a preferably moveable operating section 42 best seen in FIG. 4 and comprising frame 48 having attached casters 49 to permit its movement as described below. Operating section 42 is best seen in FIGS. 5 and 6. As depicted in these Figures, operating section 42 comprises an entrance tube 36 immersed in a bath of molten metal 43 contained in metal well 40 of furnace 38, and a pair of guide rollers 44 and 44A that serve to guide tow bundle 32 in a planar path through molten metal 43 and beneath ultrasonic processor 46 that facilitates wetting and infiltration of molten metal into tow bundle 34. Ultrasonic processor 46 and its associated equipment described below as well as entrance tube 36 are all carried by frame 48. As will be apparent from a review of FIGS. 4 and 5, frame 48 to which ultrasonic processor 46 as well as condenser board 28 are affixed is moveable, upon casters 49 so that frame 48 becomes in effect a carriage that can be relocated away from furnace 40 during furnace charging, melting and cleaning operations. Such an arrangement simplifies considerably the actual preparation and operation of apparatus 10 and especially infiltration section 14.

Ultrasonic processor 46 further comprises a cooling chamber 50 for the upper portion of the ultrasonic waveguide 52 and transducer 54. Cooling chamber 50 is preferably double walled and with a continuous gas purge therethrough. Cooling chamber 50 extends the life of transducer 54 and maintains the temperature and hence the acoustic impedance of the ultrasonic processor consistent. This control is very important for reducing process variability. A screw drive 58 is provided for raising and lowering, i.e. adjusting the locations of ultrasonic processor 46 and entrance tube 36 in metal bath 43 or for withdrawing this piece of equipment when not in use to prevent damage thereto by accident or extended and unnecessary exposure to the high temperature conditions and the erosive effects of molten metal. Ultrasonic waveguide 52 may be fabricated from any number of materials, such as titanium and niobium, however, the use of niobium is particularly preferred as it is highly resistant to the action of, for example, molten aluminum. An ultrasonic waveguide that operates in the range of about 20 kHz and a power output of about 1500 Watts have proven satisfactory in the production of a metal matrix composite tape or ribbon.

After passing in the area of ultrasonic waveguide 52 between rollers 44 and 44A the now molten metal infiltrated tow bundle 56 is passed through a die 60 to impart the desired final shape to infiltrated tow bundle 56 thereby producing reinforced metal matrix tape/ribbon 62 that passes over exit guide roll 34A toward puller 16. According to a preferred embodiment of the present invention, the die is fabricated from graphite although it could be similarly fabricated from a suitable ceramic or refractory material. A preferred dimension for tape or ribbon 62 is 0.25 inches wide by 0.015 inches thick. Other "shaping or forming" devices could also be used in place of die 60, for example a pair of facing rollers or the like. Die 60 is located such that it lies in line with infiltrated tow bundle 56 as it exits molten metal bath 43. The particular configuration of die 60 will vary widely depending upon the particular shape of the metal matrix tape or ribbon being fabricated, and, as such, its configuration in the overall metal matrix fabrication process is not particularly critical although the design or configuration of die 60 may be highly important in the fabrication of a particularly shaped metal matrix tape or ribbon.

After exiting die 60 and over exit guide roll 34A tape/ribbon 62 then passes into puller 16. Puller 16 preferably comprises a commercially available dual belt pulling system. According to a highly preferred embodiment of the present invention, puller 16 is equipped with a set of air amplifying nozzles 66 that cool tape/ribbon 62 before it comes into contact with rubber belts 68 and four-roller centering mechanism 70 of puller 16. Four-roller centering mechanism 70 maintains tape/ribbon 62 centered on belts 68.

It is puller 16 in combination with the tensioning devices associated with shafts 22 described above that maintain tension throughout apparatus 10 and that result in the production of a pultrusion effect as infiltrated fiber tow bundle 56 is drawn through die 60 by the action of puller 16 to yield tape/ribbon 62. As will be obvious to the skilled artisan, although perhaps more difficult to control a variety of devices might be substituted for puller 16. For example a sophisticated and highly automated coiling system might be used to "pull" the fiber tow through the apparatus described herein.

Upon exiting puller 16, tape/ribbon 62 can be coiled using a conventional coiling device not shown.

In practice, the apparatus just described operates as follows: spools 20 of a suitable ceramic, glass, carbon, and the like, continuous fiber are mounted in creel 12 as shown in FIGS. 1 and 3. Depending upon the size, type, strength etc., of the composite tape being produced, any number of continuous fibers may be applied from creel 12. The individual continuous fibers 21 are passed through creel payout boards 24 via apertures 26 or some other suitable alignment apparatus and then through condenser board 28 to be brought into a suitable arrangement for application to entrance roll 34. From entrance roll 34 the now bundled tow 32 passes into entrance tube 36 wherein it is placed below the surface of molten metal bath 43, generally at a depth of from about 1 to about 2 inches, and passes over guide roll 44, is impacted by ultrasonic emissions generated by waveguide 52 that assists infiltration of molten metal into tow bundle 32, passes over guide roll 44A and thence through die 60 where infiltrated tow bundle 56 is formed into an appropriately shaped tape/ribbon 62 that passes over exit roll 34A and enters puller 16 after being subjected to cooling by the impingement of air from air amplifying nozzles 66. The product tape/ribbon 62 is then coiled or otherwise collected for use.

Operating speeds on the order of from about 5 to about 15 feet per minute have been found suitable for the production of satisfactory product, although it is anticipated that operation of the apparatus described herein outside of this range is entirely feasible.

There have thus been described both an apparatus and a method for the production of continuous fiber reinforced metal matrix composites. The method described and claimed herein is relatively simple to implement, is highly reproducible and produces very consistent product over relatively long production runs.

While similar apparatus has been used to produce coated and other products in the past, applicants are not aware of any single process or combination of processes that utilize the apertured creel payout boards, apertured condenser boards, ultrasonic assisted infiltration technique, air cooling and pultrusion effects of the present invention that are described herein.

As the invention has been described, it will be apparent to those skilled in the art that the same may be varied in many ways without departing from the spirit and scope of the invention. Any and all such modifications are intended to be included within the scope of the appended claims.

What is claimed is:

1. An apparatus for the production of metal matrix ribbon or tape comprising:

a creel comprising a plurality of spools having a reinforcing continuous fiber tow wound thereon;

a mechanism for consolidating a plurality of said continuous fiber tows into a consolidated tow bundle, wherein the mechanism comprises a condenser board having a plurality of apertures and an entrance roller, wherein said condenser board is arcuate in shape, wherein the continuous fiber tows pass through the plurality of apertures and are consolidated on the entrance roller, and wherein said condenser board and entrance roller are positioned between the creel and an infiltration section, and wherein said condenser board is positioned before entry to the infiltration section;

said infiltration section comprising:

a furnace for the containment of molten metal;

a mechanism for moving said tow bundle through molten metal contained in said furnace; and an ultrasonic processor for assisting the infiltration of said molten metal into said consolidated tow bundle to form an infiltrated tow bundle; and a pulling device for drawing said tow and said consolidated tow bundle through said infiltration section.

2. The apparatus of claim 1, wherein said mechanism for consolidating said fiber tows into a consolidated tow bundle comprises at least one payout board having apertures therein for orienting said fiber tow as it moves into said infiltration section.

3. The apparatus of claim 1, wherein said infiltration section further comprises a mechanism for immersing said tow bundle in said molten metal and a mechanism for retaining said tow bundle in said molten metal such that ultrasonic emissions produced by said ultrasonic processor impact said tow bundle while it is immersed in said molten metal.

4. The apparatus of claim 3 wherein said mechanisms for immersing said tow bundle in said molten metal and for retaining said tow bundle in said molten metal comprise rollers about which said tow bundle is drawn by said pulling device.

5. The apparatus of claim 3 wherein said ultrasonic processor comprises an ultrasonic emitter fabricated from niobium or titanium.

6. The apparatus of claim 1, wherein said mechanism for immersing said tow bundle in said molten metal further includes a first roller that receives said tow bundle and guides it into an entrance tube, and a pair of guide rollers that receive said tow bundle from said entrance tube and retain said tow bundle immersed in said molten metal during impact by emissions from said ultrasonic processor.

7. The apparatus of claim 1, wherein said mechanism for moving said tow through molten metal contained in said furnace; and said ultrasonic processor are all movable from the area of said furnace when said apparatus is not in operation and capable of orientation over said furnace during operation of said infiltration section.

8. The apparatus of claim 1, wherein said pulling device comprises a dual belt puller.

9. The apparatus of claim 1, further including a die between said infiltration section and said pulling device through which said infiltrated tow bundle passes and is finally shaped before being drawn into said pulling device.

10. The apparatus of claim 1, wherein said pulling device is equipped with a cooling device that cools said infiltrated tow bundle before it enters said pulling device.

* * * * *